US010000872B2

(12) United States Patent
Ueda

(10) Patent No.: US 10,000,872 B2
(45) Date of Patent: Jun. 19, 2018

(54) SEWING MACHINE

(71) Applicant: BROTHER KOGYO KABUSHIKI KAISHA, Nagoya-shi, Aichi-ken (JP)

(72) Inventor: Daisuke Ueda, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 344 days.

(21) Appl. No.: 14/837,530

(22) Filed: Aug. 27, 2015

(65) Prior Publication Data

US 2016/0083884 A1 Mar. 24, 2016

(30) Foreign Application Priority Data

Sep. 24, 2014 (JP) ..... 2014-193947

(51) Int. Cl.
*D05B 65/02* (2006.01)

(52) U.S. Cl.
CPC ..... *D05B 65/02* (2013.01)

(58) Field of Classification Search
CPC .... D05B 65/00; D05B 65/003; D05B 65/006; D05B 65/02; D05B 65/06
See application file for complete search history.

(56) References Cited

U.S. PATENT DOCUMENTS 2,707,927 A * 5/1955 Rieger ..... D05B 65/00 112/291
3,211,117 A * 10/1965 Mosinski ..... D05B 65/00 112/292
3,386,402 A * 6/1968 Ross ..... D05B 65/00 112/292
3,867,892 A * 2/1975 Ciecior ..... D05B 65/00 112/288
4,401,045 A * 8/1983 Russell ..... D05B 65/00 112/286
4,630,559 A * 12/1986 Kinoshita ..... D05B 65/00 112/291
5,025,738 A * 6/1991 Sato ..... D05B 65/00 112/253
5,025,739 A * 6/1991 Inoue ..... D05B 65/06 112/253
5,372,079 A * 12/1994 Kitai ..... D05B 65/00 112/291

(Continued)

FOREIGN PATENT DOCUMENTS

JP H09-239173 A 9/1997
JP 2004-222918 A 8/2004

(Continued)

*Primary Examiner* — Danny Worrell
(74) *Attorney, Agent, or Firm* — Oliff PLC

(57) ABSTRACT

A sewing machine includes a cutting mechanism, a picker, and a drive portion. The cutting mechanism, which cuts an upper thread and a lower thread, is provided close to a shuttle that supplies the lower thread. The picker is provided such that it is able to move between an operating position and a non-operating position. The operating position is a position of the picker where the picker is proximate to the shuttle. The non-operating position is a position of the picker farther away from the shuttle than the operating position. The picker holds the upper thread in the operating position. The drive portion is provided as a common drive source for a cutting operation by the cutting mechanism and for movement of the picker.

6 Claims, 15 Drawing Sheets

(56) References Cited

U.S. PATENT DOCUMENTS

| | | | | |
|---|---|---|---|---|
| 5,784,990 | A | 7/1998 | Shimizu et al. | |
| 6,860,213 | B2 | 3/2005 | Shimizu | |
| 6,907,834 | B2 * | 6/2005 | Noguchi | D05B 65/06 112/225 |
| 7,093,549 | B2 * | 8/2006 | Fujihara | D05B 65/02 112/286 |
| 7,905,190 | B2 * | 3/2011 | Shimizu | D05B 65/06 112/254 |
| 2004/0225404 | A1 | 11/2004 | Shimizu | |

FOREIGN PATENT DOCUMENTS

| | | | |
|---|---|---|---|
| JP | 2004-290293 | A | 10/2004 |
| JP | 2009-005996 | A | 1/2009 |
| JP | 2013-070915 | A | 4/2013 |

* cited by examiner

SEWING MACHINE

CROSS-REFERENCE TO RELATED APPLICATION

This application claims priority to Japanese Patent Application No. 2014-193947 filed on Sep. 24, 2014, the disclosure of which is herein incorporated by reference in its entirety.

BACKGROUND

The present disclosure relates to a sewing machine.

A sewing machine is known that is provided with a cutting mechanism and a picker. The cutting mechanism is configured such that it cuts an upper thread and a lower thread when replacing the upper thread and/or when terminating sewing. The picker is configured such that it can hold the upper thread. The cutting mechanism is driven by a thread cutting motor. The picker is driven by a picker drive motor.

SUMMARY

For some time, there has been a demand for further simplification of the configurations that are related to the cutting mechanism and the picker in this type of sewing machine. Various embodiments of the general principles described herein provide a sewing machine in which the configurations that are related to the cutting mechanism and the picker have been satisfactorily simplified.

An embodiment provides a sewing machine that is provided with a cutting mechanism, a picker, and a drive portion. The cutting mechanism, which cuts an upper thread and a lower thread, is provided close to a shuttle that supplies the lower thread. The picker is provided such that it is able to move between an operating position and a non-operating position. The operating position is a position of the picker where the picker is proximate to the shuttle. The non-operating position is a position of the picker farther away from the shuttle than the operating position. The picker is configured such that it holds the upper thread in the operating position. The drive portion is provided as a common drive source for a cutting operation by the cutting mechanism and for movement of the picker.

BRIEF DESCRIPTION OF THE DRAWINGS

Embodiments will be described below in detail with reference to the accompanying drawings in which.

DETAILED DESCRIPTION

Figure 1:
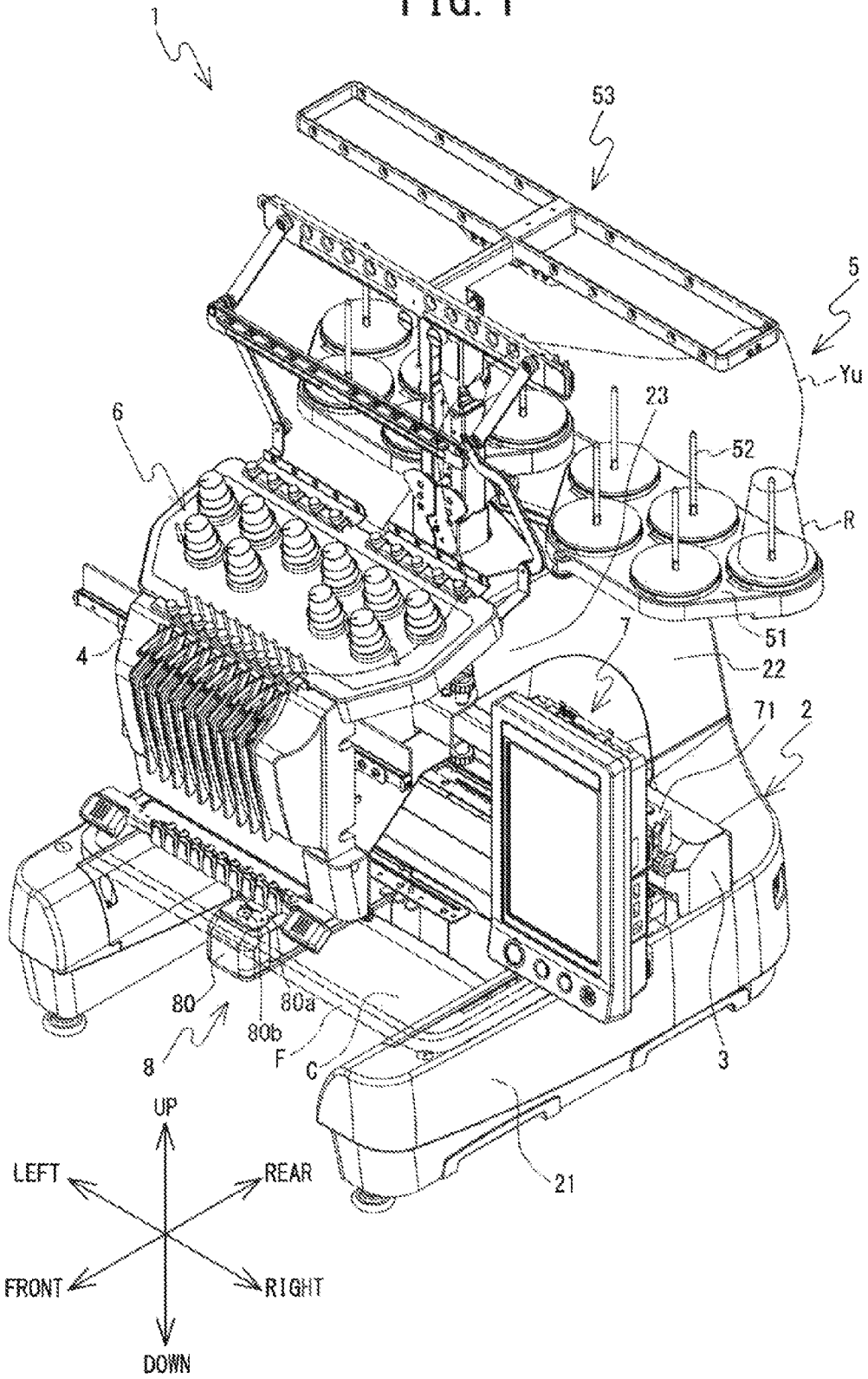
FIG. 1 is a perspective view that shows an overall configuration of a sewing machine of an embodiment.

The top side, the bottom side, the lower right side, the upper left side, the lower left side, and the upper right side in FIG. 1 respectively indicate the top side, the bottom side, the right side, the left side, the front side, and the rear side of a sewing machine 1.

Figure 2:
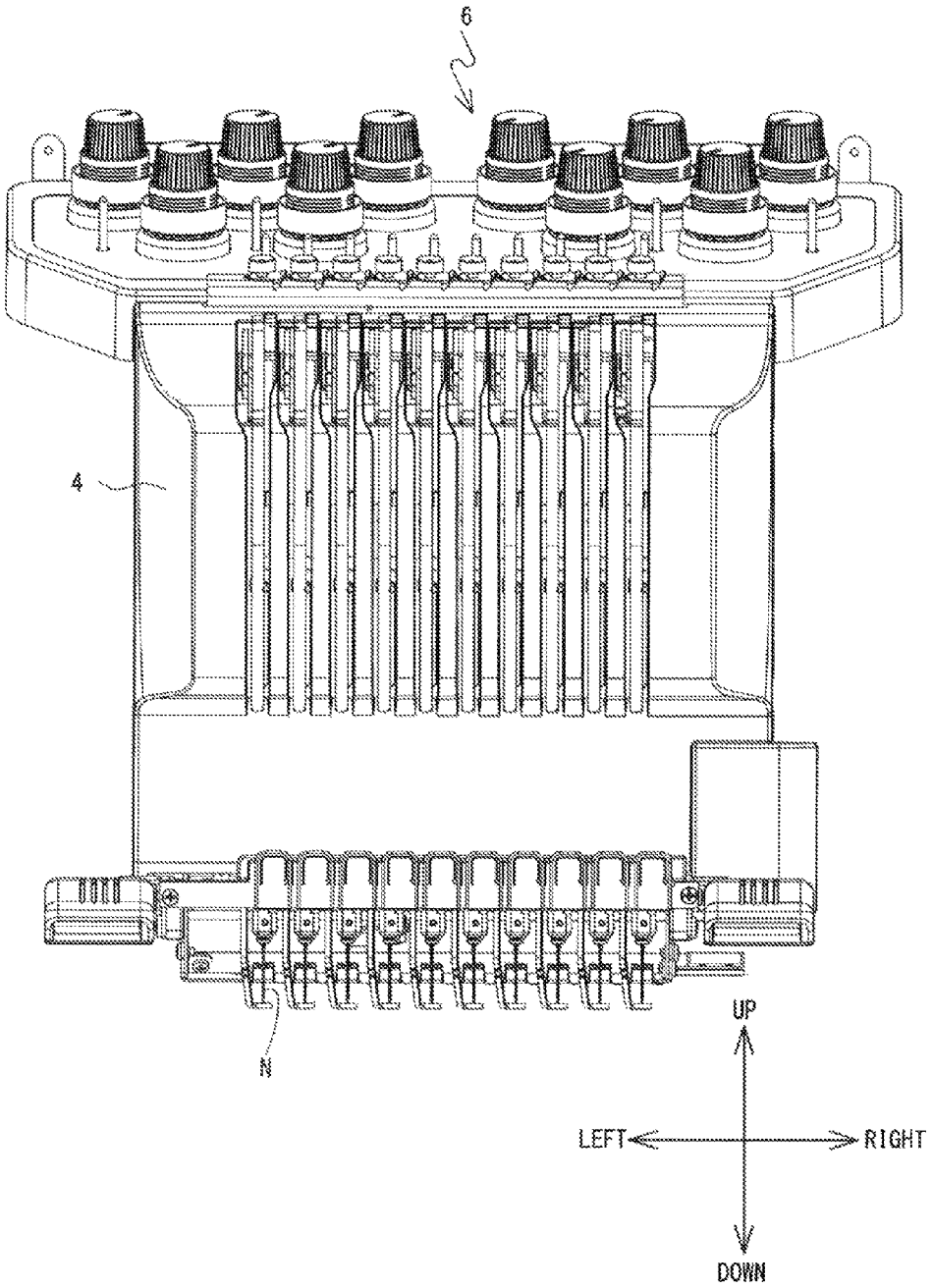
FIG. 2 is an enlarged front view of a needle case that is shown in FIG. 1.

Referring to FIGS. 1 and 2, the sewing machine 1 of the present embodiment, is a multi-needle sewing machine that is provided with a plurality of needle bars (not shown in the drawings). A sewing needle N (refer to FIG. 2) can be mounted on each one of the plurality of the needle bars. The sewing machine 1 of the present embodiment is configured such that, by selectively operating the plurality of the needle bars, it can form, in a work cloth C that is held in an embroidery frame F, an embroidery pattern that is made up of a plurality of types of upper threads Yu, each of which is a different color. The sewing machine 1 is provided with a body 2, an embroidery frame moving mechanism 3, a needle bar case 4, an upper thread supply portion 5, a tensioner mechanism 6, an operation panel 7, and a cylinder bed 8.

The body 2 is provided with a foot 21, a pillar 22, and an arm 23. The foot 21, which makes up the base portion of the sewing machine 1, is formed approximately into an inverted U shape in a plan view. The pillar 22 is provided such that it extends upward from the rear edge portion of the foot 21. The arm 23 is provided such that it extends toward the front from the upper end portion of the pillar 22.

The embroidery frame moving mechanism 3 is disposed below the arm 23. The embroidery frame F is removably mounted on the embroidery frame moving mechanism 3. The embroidery frame moving mechanism 3 is configured such that it moves the mounted embroidery frame F toward the front and the rear and to the left and the right.

The needle bar case 4 is provided on the front edge of the arm 23. Referring to FIG. 2, the plurality of the needle bars are supported by the needle bar case 4 such that they can moved up and down. The lower ends of the needle bars are configured such that the sewing needles N can be removably mounted on them.

The upper thread supply portion 5 is mounted on the upper end portion of the pillar 22. The upper thread supply portion 5 is provided with a thread spool holder 51, thread spool pins 52, and a thread guide 53. A plurality of the thread spool pins 52 that are equal in number to the number of the needle bars are provided on the thread spool holder 51. The thread spool pins 52 are provided such that they support thread spools R around which the upper threads Yu are wound. The thread guide 53 is configured such that it guides toward the tensioner mechanism 6 the upper threads Yu that are pulled out from the thread spools R.

The tensioner mechanism 6 is provided in the upper portion of the needle bar case 4. The tensioner mechanism 6 is configured such that it can regulate the tension of the upper threads Yu. The operation panel 7 is provided with a liquid crystal touch panel and switches. The operation panel 7 is configured such that it displays various types of information to a user and accepts commands from the user. The operation panel 7 is affixed to one end of a support beam 71 that extends horizontally from the arm 23.

The cylinder bed 8 is provided below the arm 23. The cylinder bed 8 is disposed such that it faces the needle bar case 4 (the sewing needles N) via the work cloth C that is supported by the embroidery frame F. In the cylinder bed 8, a casing 80 that is a nearly square tube extends almost horizontally toward the front from the body 2. A needle plate 80*a* is affixed to the top face of the front end portion of the cylinder bed 8. A needle hole 80*b*, which is a through-hole through which the sewing needle N (refer to FIG. 2) can be inserted, is formed in the needle plate 80*a*.

Next, an internal configuration of the cylinder bed 8 will be explained with reference to FIGS. 3 to 15. A shuttle 81 is provided in the front end portion of the cylinder bed 8. The shuttle 81 is provided in the interior of the cylinder bed 8 such that it supplies the lower thread (not shown in the drawings). The shuttle 81 is configured such that a bobbin case 81*a*, which contains a bobbin (not shown in the drawings) around which the lower thread is wound, can be removably mounted in it.

A cutting mechanism 82, a upper thread holding mechanism 83, and a transmission mechanism 84 are provided in the cylinder bed 8 and are mounted on a bed frame 85. The bed frame 85 is provided with a main frame 85*a*, a sub-frame 85*b*, and a sub-frame 85*c*. The main frame 85*a* is provided such that it projects toward the front from a metal frame 90 in the body 2. The main frame 85*a* is made of metal and is formed as a single unit with the frame 90. The sub-frame 85*b* is a metal member that is formed approximately into a U shape in a plan view, and it is affixed to the top face of the front end portion of the main frame 85*a*. The sub-frame 85*c* (refer to FIGS. 4 and 5) is a metal member that is formed approximately into an L shape in a plan view, and it is affixed to the bottom face of the front end portion of the main frame 85*a*.

The cutting mechanism 82 is provided such that it is able to cut the upper thread Yu (refer to FIG. 1; hereinafter the same) and the lower thread close to the shuttle 81. The upper thread holding mechanism 83 is configured such that it can hold the upper thread Yu when sewing starts and when a cutting operation is performed by the cutting mechanism 82. The transmission mechanism 84 is configured such that it transmits to the cutting mechanism 82 and the upper thread holding mechanism 83 drive power generated by a drive motor 91 that is affixed to the side of the body 2 and that serves as a drive portion. The drive motor 91 is provided as a common drive source for the operation by the cutting mechanism 82 that cuts the upper thread Yu and the lower thread and the operation by the upper thread holding mechanism 83 that holds the upper thread Yu. The drive motor 91 is a pulse motor, and it outputs drive power to the transmission mechanism 84 through a gear mechanism 92 that is made up of a plurality of gears. The gear mechanism 92 is configured such that it takes the rotational movement that is output from the drive motor 91 and converts it to a reciprocating movement in the front-rear direction in order to transmit it to the transmission mechanism 84.

A fixed blade 821 is supported in a fixed position by the bed frame 85. A base end portion 821*a* of the fixed blade 821 is affixed to the sub-frame 85*b* by a screw. A first cutting edge part 821*b*, which is a cutting part, is formed on an end of the fixed blade 821 that projects obliquely toward the left front in the direction of the shuttle 81.

Figure 3:
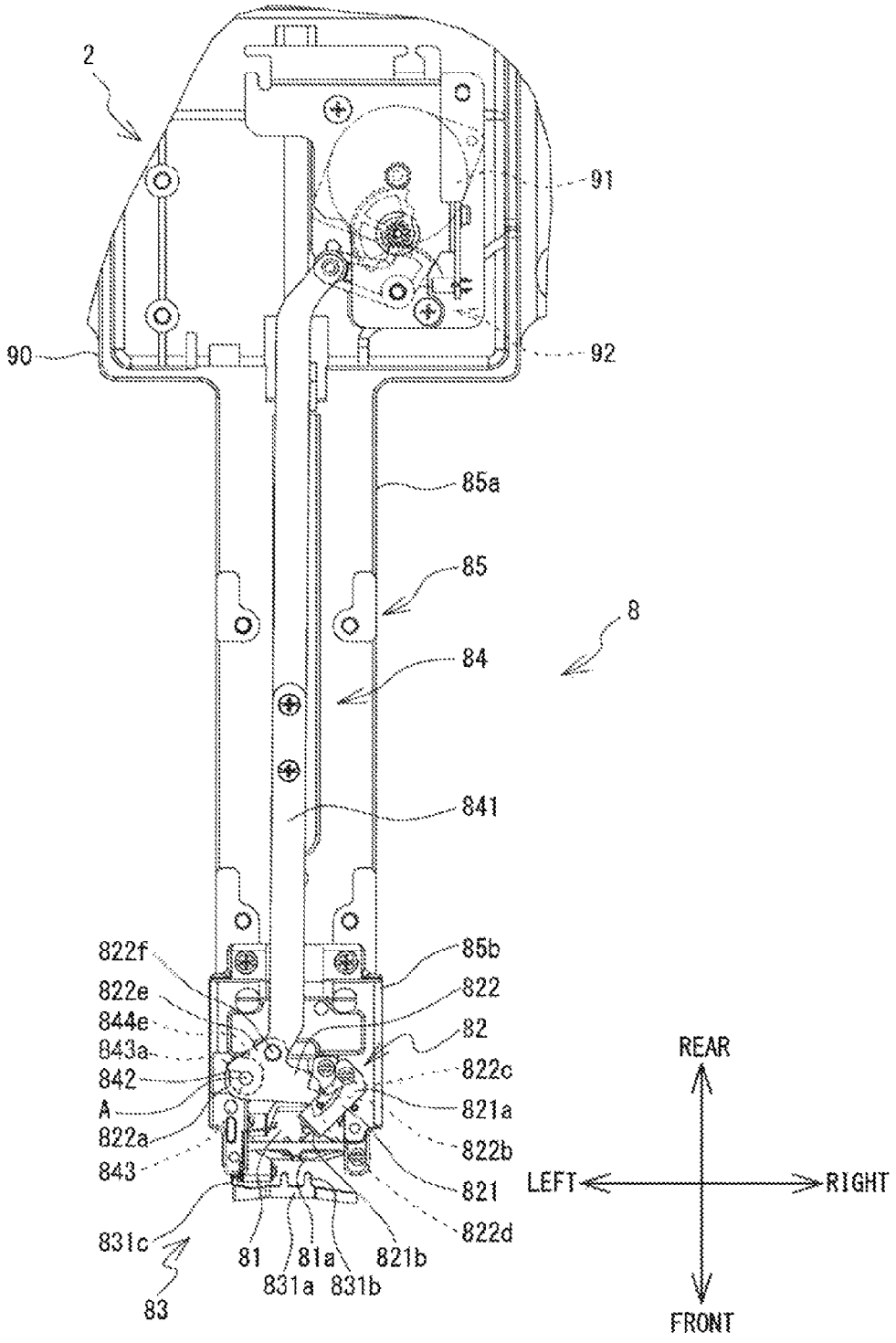
FIG. 3 is a plan view that shows an internal structure of a cylinder bed that is shown in FIG. 1.
Figure 4:
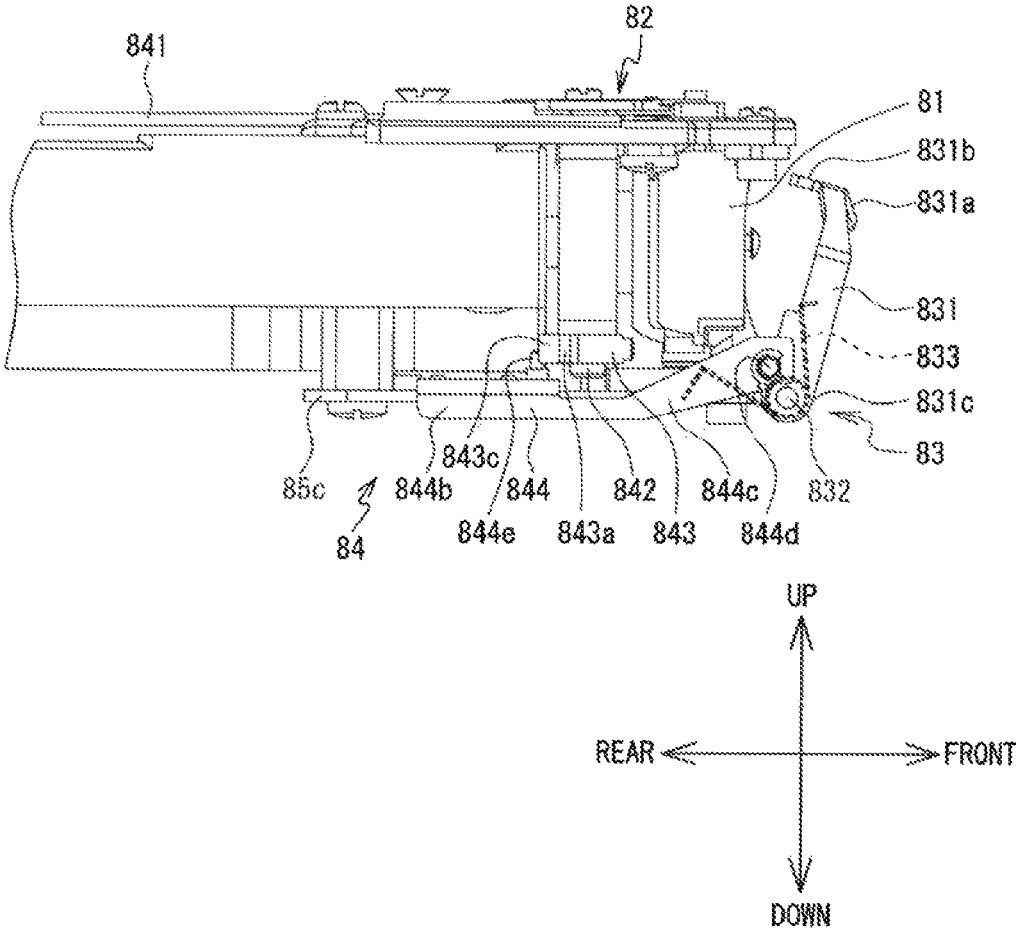
FIG. 4 is an enlarged side view of main portions of an upper thread holding mechanism and a transmission mechanism that are shown in FIG. 3.
Figure 5:
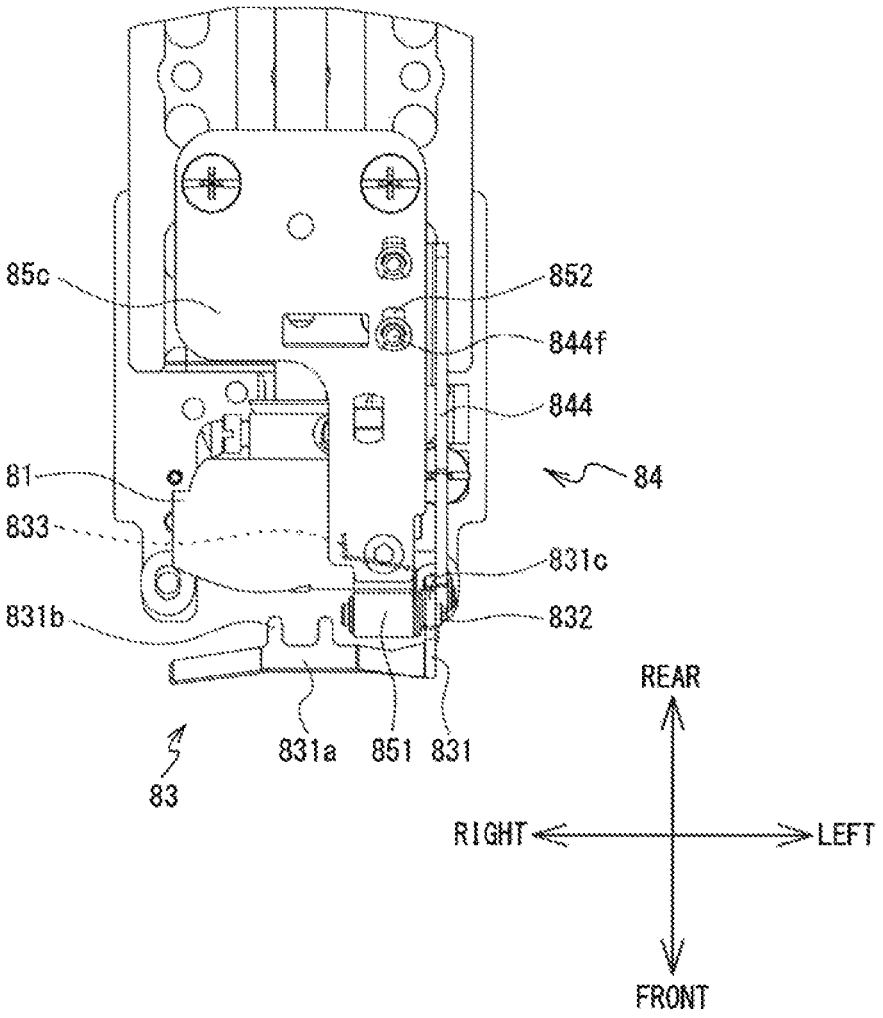
FIG. 5 is an enlarged bottom view of the main portions of the upper thread holding mechanism and the transmission mechanism that are shown in FIG. 3.
Figure 12:
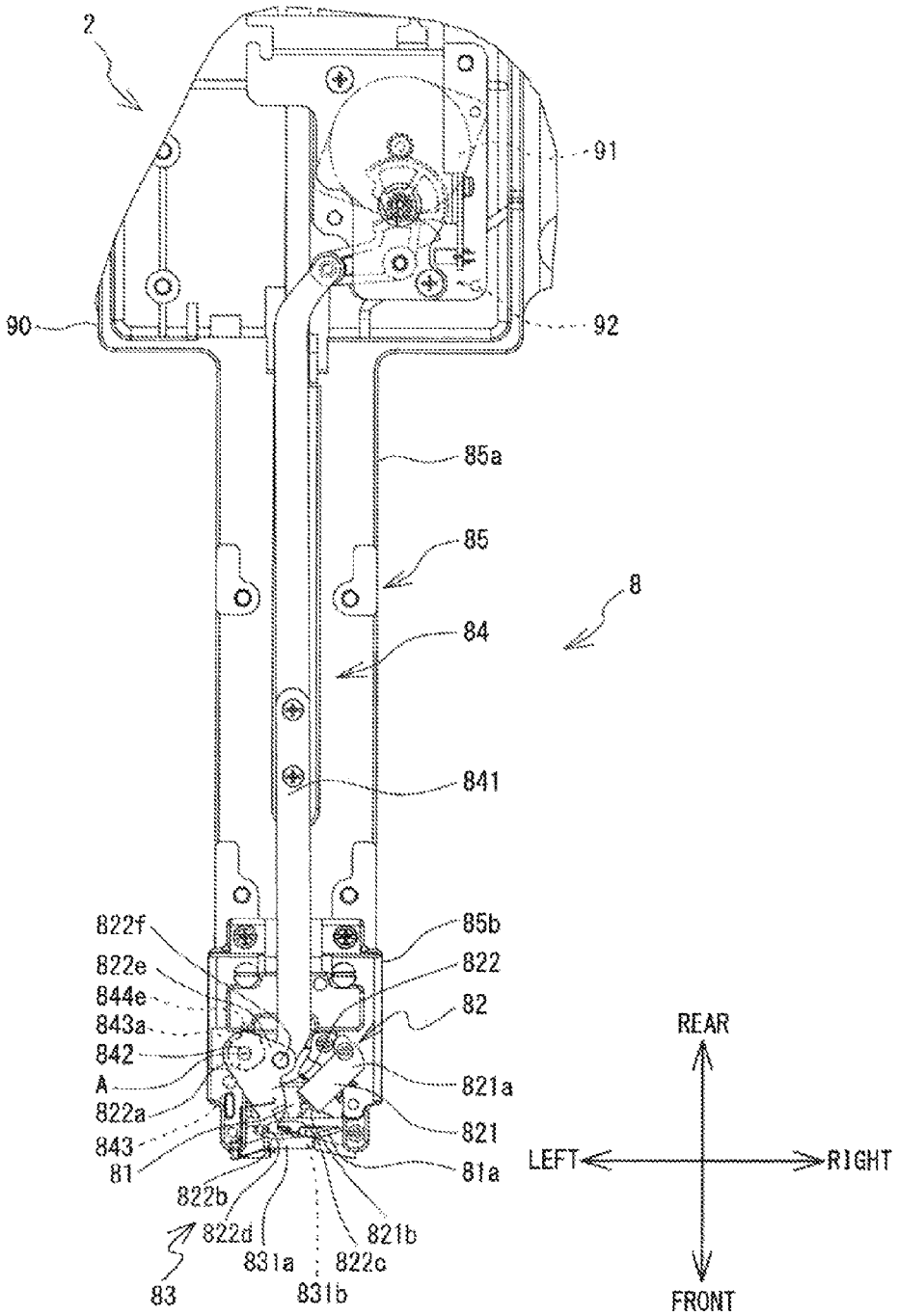
FIG. 12 is a plan view that shows an overview of operations of the cutting mechanism, the upper thread holding mechanism, and the transmission mechanism that are shown in FIG. 3.
Figure 13:
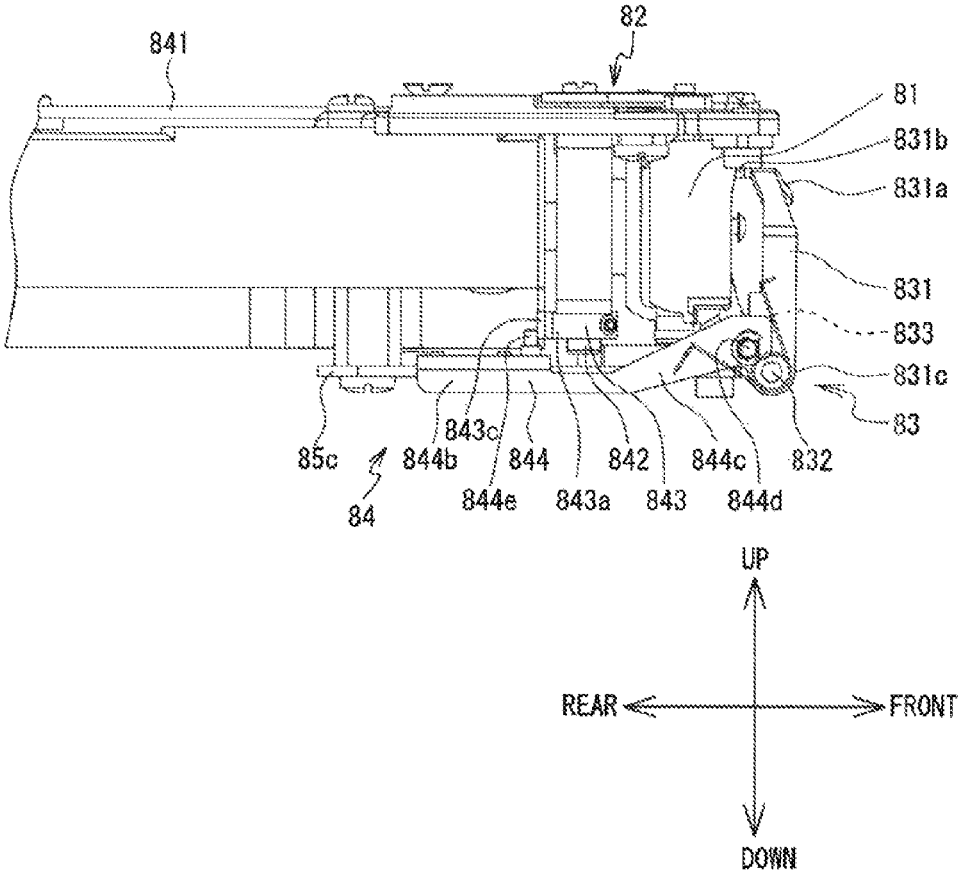
FIG. 13 is a side view that shows an overview of operations of the upper thread holding mechanism and the transmission mechanism that are shown in FIG. 4.
Figure 14:
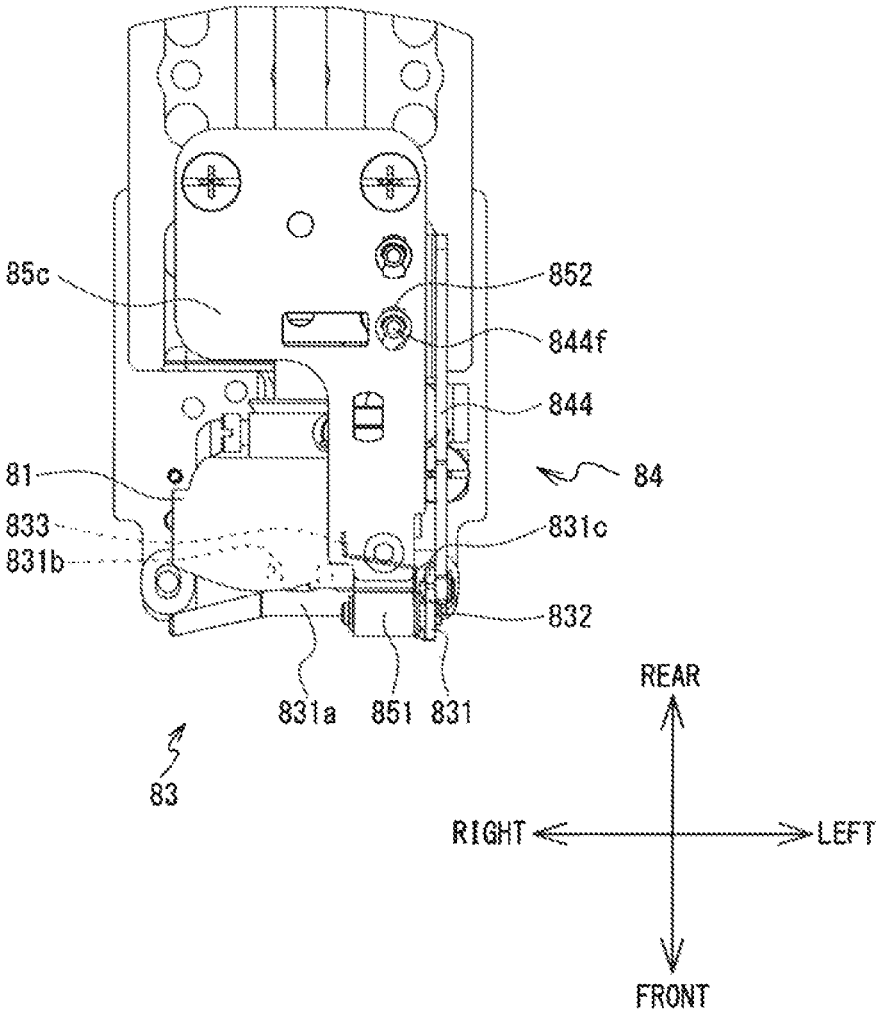
FIG. 14 is a bottom view that shows an overview of operations of the upper thread holding mechanism and the transmission mechanism that are shown in FIG. 5.
Figure 15:
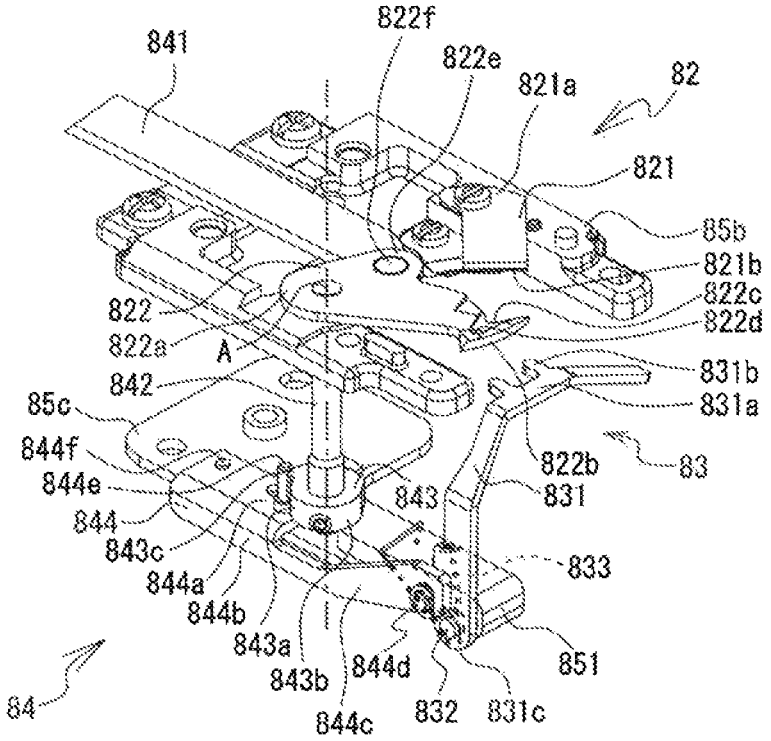
FIG. 15 is a perspective view that shows an overview of operations of the cutting mechanism, the upper thread holding mechanism, and the transmission mechanism that are shown in FIG. 6.

A movable blade 822 is supported by the sub-frame 85*b* such that it can pivot (rotate) around a pivot center A at a base end portion 822*a*. A hook portion 822*c* is formed in a free end portion 822*b* that is at the far end portion of the movable blade 822 from the base end portion 822*a*. When the movable blade 822 pivots toward an initial position (a first position) that is shown in FIG. 3 from a maximally separated position (a second position) that is shown in FIG. 12, the hook portion 822*c* hooks the upper thread Yu and the lower thread. The movable blade 822 is provided such that it can be pivoted between the initial position and the maximally separated position by the drive motor 91.

A second cutting edge part 822*d* is formed in the hook portion 822*c* of the movable blade 822. The second cutting edge part 822*d* is a cutting part that is formed by a nearly circular edge on the upper end of a cylindrical through-hole that is formed in the up-down direction. The second cutting edge part 822*d* is provided in a position where it does not come into contact with the first cutting edge part 821*b* of the fixed blade 821 while the movable blade 822 is pivoting between the initial position (the first position) and a picking position (a third position). The initial position and the picking position will be described later.

An operating portion 822*e* is formed in the movable blade 822. The operating portion 822*e* is provided to the rear of a position between the base end portion 822*a* and the free end portion 822*b* (specifically, a position that is closer to the base end portion 822*a* than is an intermediate position between the base end portion 822*a* and the free end portion 822*b*). The operating portion 822*e* is coupled to the transmission mechanism 84 through a coupling pin 822*f*. The movable blade 822 is configured such that it can be pivoted around the pivot center A by using the transmission mechanism 84 to operate the operating portion 822*e* in the front-rear direction. The configuration of the cutting mechanism 82 that is provided with the fixed blade 821 and the movable blade 822 as described above is of the same sort as the configurations that are disclosed in Japanese Laid-Open Patent Publication No. 9-239173 (U.S. Pat. No. 5,784,990) and Japanese Laid-Open Patent Publication No. 2004-290293 (U.S. Pat. No. 6,860,213).

The upper thread holding mechanism 83 (also called the picker mechanism) is mainly provided with a picker 831. A tip portion 831*a* of the picker 831 includes a pair of projections 831*b*. Each of the pair of projections 831*b* is provided such that it projects toward the shuttle 81. The picker 831 is provided such that it is able to move between an operating position and a non-operating position. The operating position is a position of the picker 831 where the pair of projections 831*b* come close to the shuttle 81 (specifically, where the pair of projections 831*b* almost touch the bobbin that is contained in the bobbin case 81*a* that is mounted in the shuttle 81) (refer to FIGS. 8 to 11). The non-operating position is a position of the picker 831 where the pair of projections 831*b* are farther away from the shuttle 81 than the operating position (refer to FIGS. 3 to 6). The picker 831 is configured such that it is able to hold the upper thread Yu in the operating position described above. The configuration of the picker 831 described above is of the same sort as the configuration that is disclosed in Japanese Laid-Open Patent Publication No. 2004-290293 (U.S. Pat. No. 6,860,213).

In the present embodiment, a base end portion 831*c* of the picker 831 is supported by the sub-frame 85*c* through a support shaft 832, such that the picker 831 is able to pivot. The support shaft 832 is provided such that it is parallel to the left-right direction. An energizing spring 833 is provided around the support shaft 832. The energizing spring 833 is a torsion coil spring. The support shaft 832 is inserted into the coil portion of the energizing spring 833. One end of the energizing spring 833 is anchored to the sub-frame 85*c*. The other end of the energizing spring 833 is anchored to the picker 831, such that the energizing spring 833 energizes the picker 831 (the tip portion 831*a*) in the direction that moves it away from the shuttle 81.

The configuration of the transmission mechanism 84 will now be explained in detail. An operating lever 841 is a member that is bar-shaped in a plan view, with its lengthwise direction in the front-rear direction, and one end of it is coupled to the gear mechanism 92. The operating lever 841 is provided such that it is moved in the front-rear direction by the rotation of the drive motor 91. The other end of the operating lever 841 is coupled to the operating portion 822*e* of the movable blade 822 through the coupling pin 822*f*.

A transmission shaft 842 is a round bar-shaped member, and it is provided on the same axis as the pivot center A of the movable blade 822. One end of the transmission shaft 842 is joined to the base end portion 822*a* of the movable blade 822, such that it rotates in conjunction with the pivoting of the movable blade 822. The movable blade 822 and the transmission shaft 842 are fastened to one another to form a single unit.

A cam member 843 is mounted on the other end of the transmission shaft 842. The cam member 843 is joined to the transmission shaft 842 such that it rotates (pivots) in conjunction with the pivoting of the movable blade 822. The cam member 843 is affixed to the transmission shaft 842 such that it does not rotate in relation to the transmission shaft 842.

Figure 6:
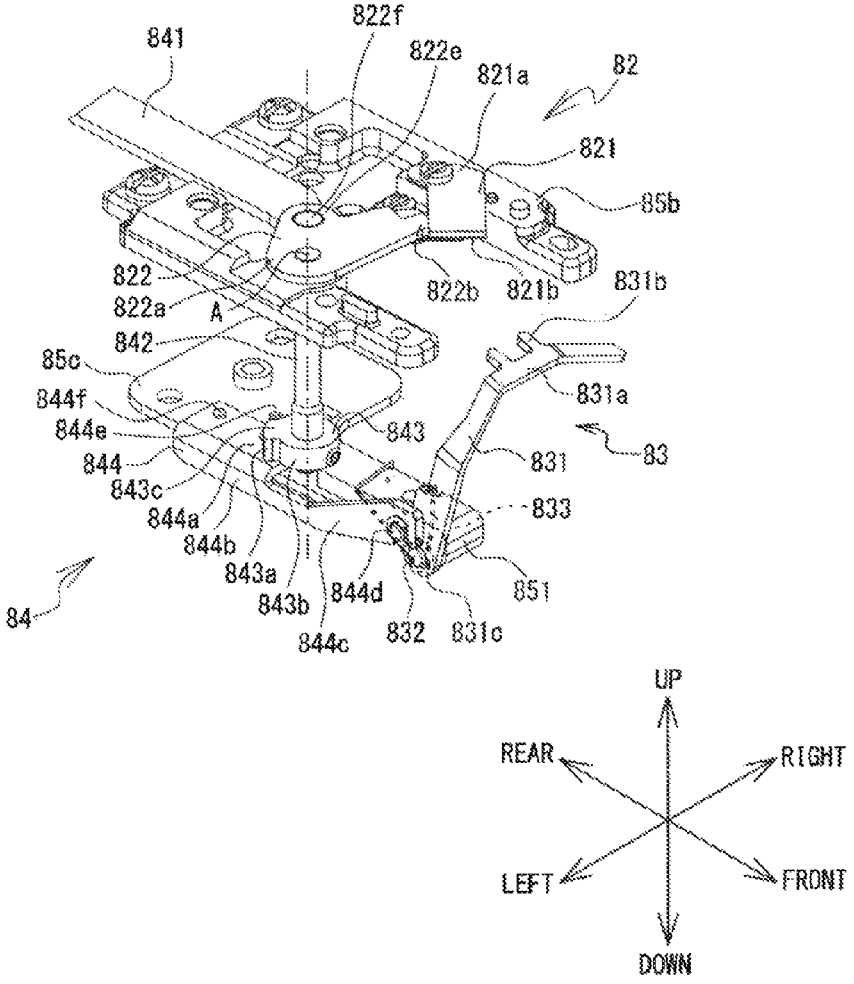
FIG. 6 is an enlarged perspective view of the main portions of a cutting mechanism, the upper thread holding mechanism and the transmission mechanism that are shown in FIG. 3.
Figure 7:
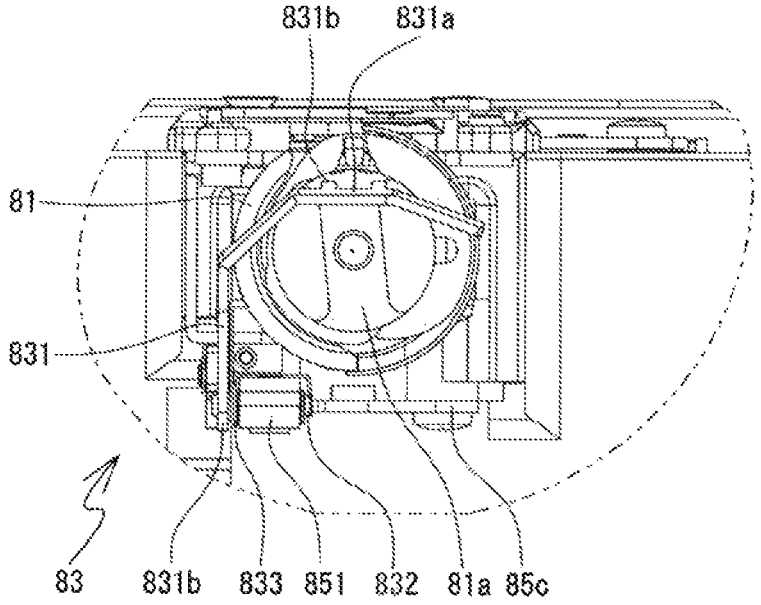
FIG. 7 is an enlarged front view of the main portion of the upper thread holding mechanism that is shown in FIG. 3.

The cam member 843 has a cam face 843*a*. The cam face 843*a* has a specified cam shape (refer to the broken line in FIG. 3) in a direction that is orthogonal to the central axis of the transmission shaft 842 (refer to the dashed-dotted line in FIG. 6 that is parallel to the up-down direction and passes through the pivot center A). Referring to FIG. 6, the cam member 843 includes a cylindrical portion 843*b* and a projecting portion 843*c*. The projecting portion 843*c* is a portion that is provided such that it projects toward the rear from the cylindrical portion 843*b*. The projecting portion 843*c* has an external shape in which an outer edge that is farthest from the central axis has a circular arc shape in a plan view. The cam face 843*a* is formed by the outer surfaces of the cylindrical portion 843*b* and the projecting portion 843*c*.

A moving member 844 is provided below the cam member 843 such that it is able to move in the front-rear direction in accordance with the rotational phase of the cam member 843. The moving member 844 includes a base portion 844*a*, a flange portion 844*b*, a connecting portion 844*c*, a coupling pin 844*d*, a cam follower pin 844*e*, and a guide pin 844*f*.

The base portion 844*a* is a flat plate portion that is disposed between the cam member 843 and the sub-frame 85*c*, and it is provided in a nearly horizontal orientation. The flange portion 844*b* is a portion that is provided such that it projects downward from one edge with respect to the left-right direction (specifically, the left edge in FIG. 6) of the base portion 844*a*. The flange portion 844*b* is provided such that it faces the outside edge of the sub-frame 85*c* on one side of the left-right direction (the side on which the base end portion 831*c* of the picker 831 is provided). The connecting portion 844*c* is a portion that is provided such that it extends from the flange portion 844*b* toward the base end portion 831*c* of the picker 831. The base portion 844*a*, the flange portion 844*b* and the connecting portion 844*c* are formed as a single unit.

The tip portion (the forward end portion) of the connecting portion 844*c* is coupled to the picker 831 by the coupling pin 844*d*, close to the base end portion 831*c* (in a position that is slightly above and to the rear of the support shaft 832). The moving member 844 is configured such that it pivots the picker 831 in the front-rear direction in conjunction with its own movement in the front-rear direction. The support shaft 832, which supports the picker 831 such that the picker 831 can pivot, is inserted into a shaft support portion 851, which is at the front end portion of the sub-frame 85*c*. The picker 831 is rotatably supported close to the moving member 844 and is coupled to the moving member 844.

The cam follower pin 844*e* is provided such that it projects upward from the base portion 844*a* and faces the cam face 843*a*. The moving member 844 is configured such that, by being coupled through the coupling pin 844*d* to the picker 831, which is constantly energized toward the front by the energizing spring 833, it keeps the cam follower pin 844*e* constantly in contact with the cam face 843*a*, regardless of the rotational phase of the cam member 843. The moving member 844 is provided such that it moves in the front-rear direction in conjunction with the rotation of the cam member 843, while maintaining contact with the cam face 843*a*.

The guide pin 844*f* is provided such that it projects downward from the base portion 844*a*. The guide pin 844*f* is a cylindrical member, and it is inserted into a guide hole 852 in the sub-frame 85*c*. The guide hole 852 is a through-hole that extends through the sub-frame 85*c* in the up-down direction, and it is formed in an oblong shape whose lengthwise direction is in the front-rear direction in a plan view. The guide pin 844*f* is provided such that it is able to move in the front-rear direction as it slides against an inner wall of the guide hole 852. The guide pin 844*f* and the guide hole 852 are configured such that they guide the movement of the moving member 844 in the front-rear direction. As described above, the picker 831 is configured such that it is able to pivot between the operating position and the non-operating position in conjunction with the movement of the moving member 844.

In the present embodiment, the transmission mechanism 84 is configured such that the picker 831 moves from the non-operating position to the operating position when the movable blade 822 moves from the initial position (the first position; refer to FIGS. 3 to 6) to the picking position (the third position; refer to FIGS. 8 to 11). The term "picking position" denotes the pivot position (the rotational phase) of the movable blade 822 at the point when the picker 831 arrives at the operating position for the first time, after the movement of the picker 831 toward the shuttle 81 from the non-operating position has been started by the starting of the movement of the movable blade 822 from the initial position (the first position) toward the maximally separated position (the second position; refer to FIGS. 12 to 15). In the transmission mechanism 84, a phase relationship between the movable blade 822 and the cam member 843 is set such that the operation described above is achieved.

The operation of the sewing machine 1 of the present embodiment (particularly the cutting mechanism 82, the upper thread holding mechanism 83, and the transmission mechanism 84 of the cylinder bed 8), and effects of the configuration that is described above, will now be explained.

As shown in FIGS. 3 to 7, the movable blade 822 is positioned in the initial position prior to the start of operations by the cutting mechanism 82 and the upper thread holding mechanism 83. In the initial position, the second cutting edge part 822*d* is positioned below the fixed blade 821, in a position that is closer to the base end 821*a* than is the first cutting edge part 821*b*. At this time, the cam member 843 is in a rotational phase where the portion of the cam face 843*a* that corresponds to the cylindrical portion 843*b* is facing the cam follower pin 844*e*. The picker 831 is positioned in the non-operating position, where it is separated from the shuttle 81. Hereinafter, the state that is shown in FIGS. 3 to 7 will be called the initial state. For as long as the initial state is maintained, the drive motor 91 is not supplied with electric power.

When a specified forward rotation drive pulse is input to the drive motor 91 and the drive motor 91 is driven in forward rotation, the operating lever 841 moves toward the front. When the input of the drive pulse to the drive motor 91 stops, the operating lever 841 stops. When a specified reverse rotation drive pulse is input to the drive motor 91 and the drive motor 91 is driven in reverse rotation, the operating lever 841 moves toward the rear.

When the operating lever 841 moves in the front-rear direction, the movable blade 822 pivots (rotates). The transmission shaft 842, which is affixed to the base end portion 822*a* of the movable blade 822, rotates in conjunction with the pivoting of the movable blade 822. The cam member 843 rotates in conjunction with the rotation of the transmission shaft 842. The cam follower pin 844*e*, which is constantly in contact with the cam face 843*a*, moves in the front-rear direction in accordance with the rotational phase of the cam member 843. The connecting portion 844*c* of the moving member 844 moves in the front-rear direction in conjunction with the movement of the cam follower pin 844*e* in the front-rear direction. That causes the picker 831 to pivot in the front-rear direction around the support shaft 832.

Figure 8:
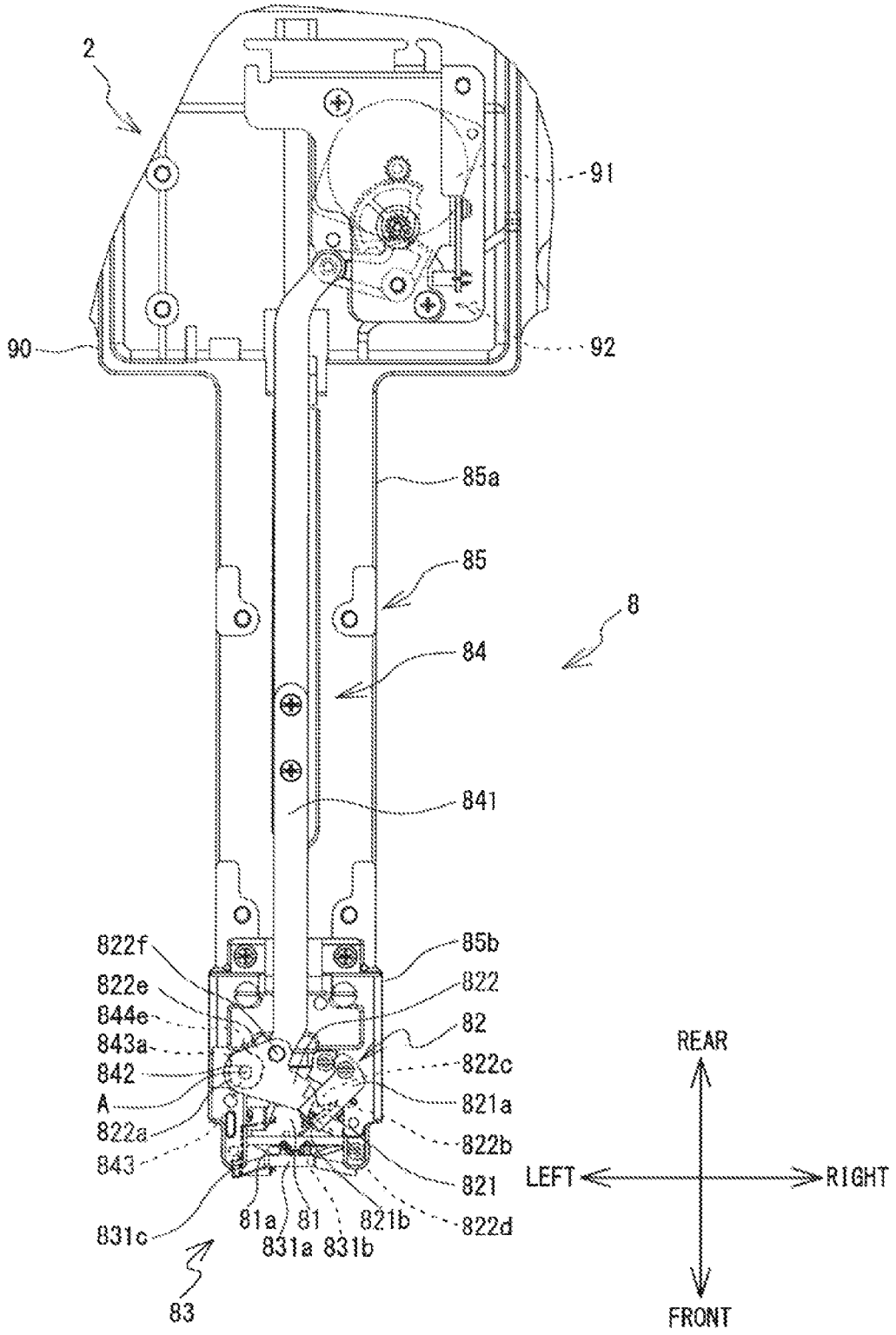
FIG. 8 is a plan view that shows the main portions of the cutting mechanism, the upper thread holding mechanism, and the transmission mechanism that are shown in FIG. 3.
Figure 9:
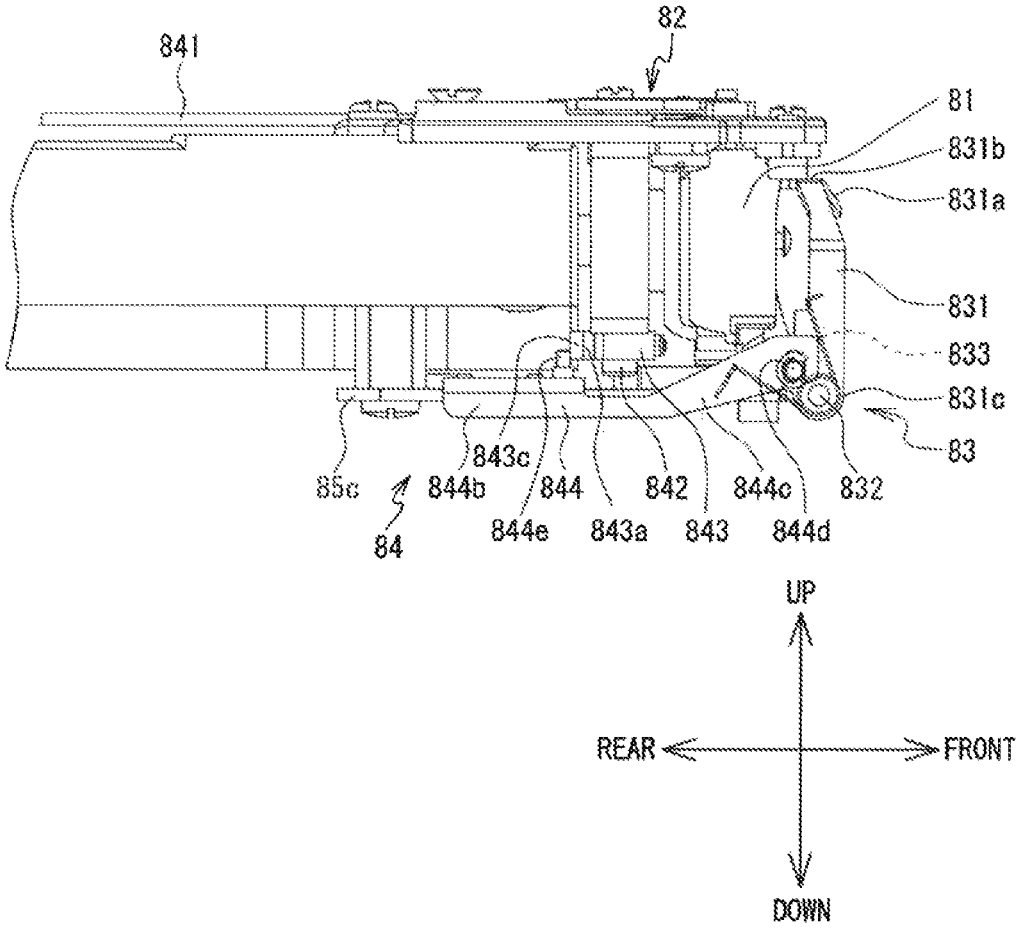
FIG. 9 is a side view that shows an overview of operations of the upper thread holding mechanism and the transmission mechanism that are shown in FIG. 4.
Figure 10:
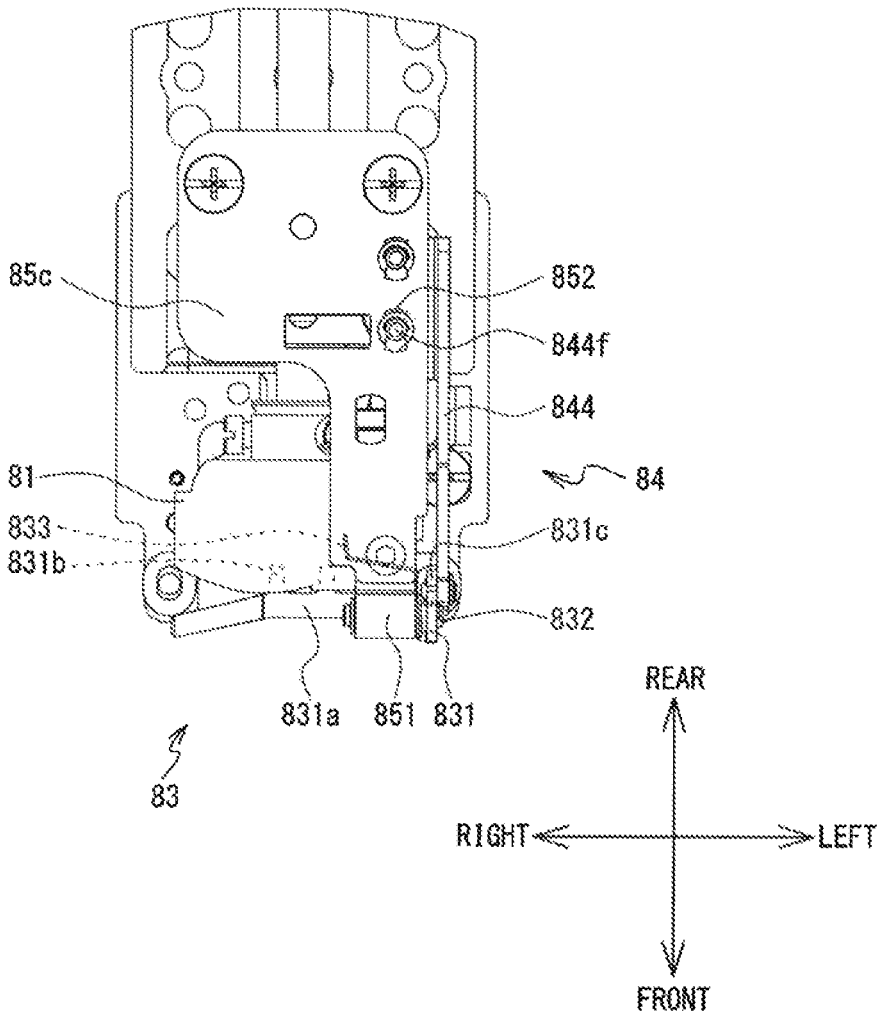
FIG. 10 is a bottom view that shows an overview of operations of the upper thread holding mechanism and the transmission mechanism that are shown in FIG. 5.
Figure 11:
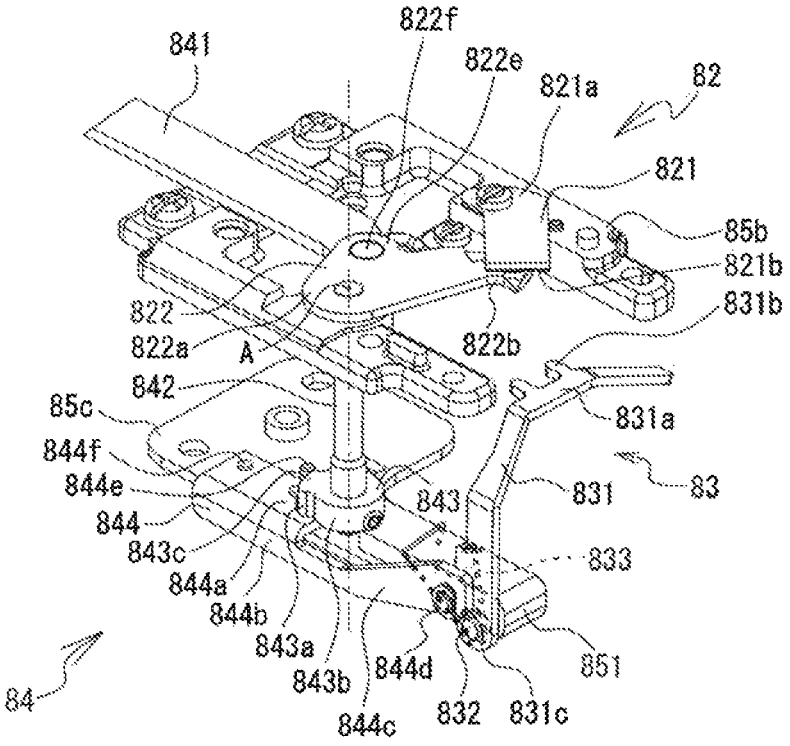
FIG. 11 is a perspective view that shows an overview of operations of the cutting mechanism, the upper thread holding mechanism, and the transmission mechanism that are shown in FIG. 6.

When the operations of the cutting mechanism 82 and the upper thread holding mechanism 83 are started, the movable blade 822 starts to pivot away from the initial position (in FIG. 3, rotating in the clockwise direction around the pivot center A). The second cutting edge part 822*d* of the movable blade 822 thus moves toward the first cutting edge part 821*b* of the fixed blade 821 in a plan view. At the point when the movable blade 822 has pivoted to the picking position (refer to FIG. 8), just before the second cutting edge part 822*d* arrives at the first cutting edge part 821*b*, the cam follower pin 844*e* comes into contact with the portion of the cam face 843*a* that corresponds to the projecting portion 843*c*, as shown in FIGS. 8 and 11. The moving member 844 thus moves toward the rear against the energizing force of the energizing spring 833. That causes the picker 831 to pivot to the operating position, as shown in FIGS. 8 to 11.

In a case where the upper thread holding mechanism 83 operates to hold the upper thread Yu at the time when sewing (the forming of an embroidery pattern) that uses one of the upper threads Yu starts, the state that is shown in FIGS. 8 to 11 is maintained until just before the first stitch is formed. The picker 831 is maintained in the operating position during this time. Thereafter, the drive motor 91 is driven in reverse rotation, and the state of the cutting mechanism 82 and the upper thread holding mechanism 83 reverts to the initial state that is shown in FIGS. 3 to 7. In this case, the second cutting edge part 822*d* of the movable blade 822 does not come into contact with the first cutting edge part 821*b* of the fixed blade 821 during the interval from when the operations of the cutting mechanism 82 and the upper thread holding mechanism 83 start until the mechanisms return to the initial state. In a case where the cutting operation is not performed by the cutting mechanism 82, contact between the second cutting edge part 822*d* of the movable blade 822 and the first cutting edge part 821*b* of the fixed blade 821 is avoided even though the movable blade 822 pivots.

In a case where the cutting operation that cuts the upper thread Yu and the lower thread is performed after the sewing (the forming of an embroidery pattern) that used one of the upper threads Yu has ended, the movable blade 822, starting from the state that is shown in FIGS. 8 to 11, pivots farther (in FIG. 8, rotating in the clockwise direction), until it reaches the maximally separated position that is shown in FIG. 12. The state in which the cam follower pin 844*e* is in contact with the portion of the cam face 843*a* that corresponds to the projecting portion 843*c* is maintained during this interval as well. The picker 831 is also maintained in the operating position during this interval.

The reversing of the rotational direction of the drive motor 91, starting from the state that is shown in FIGS. 12 to 15, causes the movable blade 822 to start pivoting (rotating) from the maximally separated position toward the initial position. The upper thread Yu and the lower thread are thus hooked well by the hook portion 822*c*. The picker 831 is maintained in the operating position at this time as well.

Thereafter, the second cutting edge part 822*d* of the movable blade 822 moves toward the first cutting edge part 821*b* in a plan view while the picker 831 is maintained in the operating position. The second cutting edge part 822*d* of the movable blade 822 then intersects with the first cutting edge part 821*b* of the fixed blade 821 just before the state in FIG. 8 is reached. The upper thread Yu and the lower thread that have been hooked by the hook portion 822*c* of the movable blade 822 are thus cut. When the movable blade 822 pivots toward the initial position, even slightly, from the state that is shown in FIGS. 8 to 11, the picker 831 moves from the operating position to the non-operating position. Then, when the movable blade 822 arrives at the initial position, the cutting mechanism 82 and the upper thread holding mechanism 83 return to the initial state.

In the configuration of the present embodiment, the cutting mechanism 82, which cuts the upper thread Yu and the lower thread, and the upper thread holding mechanism 83 (the picker 831), which holds the upper thread Yu, are driven by the drive motor 91, which is the common drive source, through the transmission mechanism 84. According to this configuration, it is not necessary for a drive source and a drive power transmission mechanism for driving the cutting mechanism 82 to be provided separately from a drive source and a drive power transmission mechanism for driving the upper thread holding mechanism 83 (the picker 831). It is thus possible to make the configuration that relates to the cutting mechanism 82 and the upper thread holding mechanism 83 (the picker 831) simpler than the known configuration. For example, favorable cost reductions are attained by reducing the number of parts and the manufacturing workload. Furthermore, the internal configuration of the cylinder bed 8 has been made simpler and more compact, providing a greater degree of freedom in the design of the sewing machine 1.

In the configuration of the present embodiment, the upper thread Yu and the lower thread are cut during the interval when the movable blade 822 is returning to the initial position after having moved from the initial position to the maximally separated position. For its part, the picker 831 moves from the non-operating position to the operating position when the movable blade 822 moves to the picking position (more specifically, when the movable blade 822 arrives at the picking position) in the course of moving toward the maximally separated position from the initial position. Therefore, according to this configuration, it is possible to operate both the cutting mechanism 82 and the picker 831 using a common drive source.

In the configuration of the present embodiment, the first cutting edge part 821*b* and the second cutting edge part 822*d* do not come into contact during the interval when the movable blade 822 moves from the initial position to the picking position, that is, the interval when the picker 831 moves from the non-operating position to the operating position. Particularly in a case where the cutting operation is not performed by the cutting mechanism 82, and only the operation of holding the upper thread Yu is performed by the picker 831, the operation of holding the upper thread Yu is completed without the first cutting edge part 821*b* and the second cutting edge part 822*d* coming into contact. Therefore, according to this configuration, wear on the first cutting edge part 821*b* and the second cutting edge part 822*d* can be reduced well.

The present disclosure is not limited to the embodiment that is described above. That is, various types of modifications can be made to the embodiment that is described above. Several representative modified examples will now be described. In the explanation of the modified examples that follows, the same reference numerals as in the embodiment that is described above are used for the parts that have the same configurations and functions as the parts that were explained in the embodiment that is described above. Moreover, in the explanations of those parts, that explanations in the embodiment that is described above can be used as desired, insofar as they are not technologically contradictory. Of course, the modified examples are also not limited to the examples that are given below. A portion of the embodiment that is described above, and all or some of the plurality of the modified examples, can be combined as desired, insofar as they are not technologically contradictory.

For example, the present disclosure can be favorably applied to a sewing machine other than a multi-needle sewing machine. The present disclosure can also be favorably applied to a sewing machine other than an embroidery sewing machine.

The configurations of the cutting mechanism 82, the upper thread holding mechanism 83, and the transmission mechanism 84 are not limited to the configurations in the embodiment that is described above. For example, the fact that the cutting mechanism 82 and the upper thread holding mechanism 83 have a common drive source does not necessarily mean that the drive source is a single device (a motor or the like) for generating drive power. For example, a motor for moving the operating lever 841 forward and a motor for moving the operating lever 841 rearward may be provided separately.

The movable blade 822 may also be driven directly by a motor that is provided in cylinder bed 8, instead of being driven through the operating lever 841. The configurations of the cutting part and the like of the movable blade 822 may also be modified as desired from the configurations that are disclosed in the embodiment that is described above. The upper thread holding mechanism 83 may also have a configuration that moves the picker 831 in parallel to the front-rear direction, instead of moving the picker 831 in the front-rear direction.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a cutting mechanism that cuts an upper thread and a lower thread, the cutting mechanism being provided closer to a shuttle than a body, the shuttle being configured to supply the lower thread, the body being provided with an upper thread supply portion;

a picker that is rotatably supported around a support shaft, the picker moving between an operating position proximate to the shuttle and a non-operating position further away from the shuttle than the operating position, the picker holding the upper thread in the operating position;

a drive portion that, as a common drive source for the cutting mechanism and the picker, outputs drive power to: (i) the cutting mechanism for a cutting operation, and (ii) the picker for movement; and a transmission mechanism that transmits drive power generated by the drive portion to the cutting mechanism and the picker, wherein the cutting mechanism is provided with:

a fixed blade having a first cutting edge part formed on a projecting end thereof, the projecting end of the fixed blade projecting toward the shuttle, and a movable blade having a second cutting edge part, the moveable blade being configured to pivot around a shaft member between a first position and a second position by the drive portion, the shaft member being fastened to the movable blade, the second cutting edge part being formed on a free end side of the movable blade;

the transmission mechanism is configured such that the picker moves from the non-operating position to the operating position when the movable blade moves from the first position to a third position that is between the first position and the second position;

the movable blade is provided with a hook portion hooking the upper thread and the lower thread when the movable blade moves from the second position to the first position; and the transmission mechanism is configured to:

pivot the movable blade around the shaft member such that the first cutting edge part and the second cutting edge part intersect with one another when the movable blade moves from the second position to the third position, to cause the movable blade to cut the upper thread and the lower thread, which have been hooked by the hook portion, maintain the picker in the operating position while the movable blade moves between the third position and the second position, and move the picker to the non-operating position while the movable blade moves between the third position and the first position.

2. The sewing machine according to claim 1, wherein the transmission mechanism is configured to move the movable blade from the first position to the third position in a state in which the first cutting edge part and the second cutting edge part are not in contact with one another.

3. The sewing machine according to claim 1, wherein the transmission mechanism is provided with:

the shaft member provided at a pivot center side of the movable blade, an end of the shaft member being joined to the movable blade such that the shaft member rotates in conjunction with pivoting of the movable blade, a cam member including a cam face, the cam face having a specified cam shape in a direction that is orthogonal to a central axis of the shaft member, the cam member being joined to another end of the shaft member such that the cam member rotates in conjunction with pivoting of the movable blade, and a moving member configured to move in conjunction with a rotation of the cam member, while maintaining contact with the cam face, and the picker is configured such that, by being rotatably supported around the support shaft and by being coupled to the moving member, the picker is able to pivot between the operating position and the non-operating position in conjunction with a movement of the moving member.

4. A sewing machine, comprising:

a cutting mechanism that cuts an upper thread and a lower thread, the cutting mechanism being provided closer to a shuttle than a body, the shuttle being configured to supply the lower thread, the body being provided with an upper thread supply portion;

a picker that is rotatably supported around a support shaft, the picker moving between an operating position proximate to the shuttle and a non-operating position further away from the shuttle than the operating position, the picker holding the upper thread in the operating position;

a drive portion that, as a common drive source for the cutting mechanism and the picker, outputs drive power to: (i) the cutting mechanism for a cutting operation, and (ii) the picker for movement; and a transmission mechanism that transmits drive power generated by the drive portion to the cutting mechanism and the picker, wherein the cutting mechanism is provided with:

a fixed blade having a first cutting edge part formed on a projecting end thereof, the projecting end of the fixed blade projecting toward the shuttle, and a movable blade having a second cutting edge part, the moveable blade being configured to pivot around a shaft member between a first position and a second position by the drive portion, the shaft member being fastened to the movable blade, the second cutting edge part being formed on a free end side of the movable blade;

the transmission mechanism is configured such that the picker moves from the non-operating position to the operating position when the movable blade moves from the first position to a third position that is between the first position and the second position;

the transmission mechanism is provided with:

the shaft member provided at a pivot center side of the movable blade, an end of the shaft member being joined to the movable blade such that the shaft member rotates in conjunction with pivoting of the movable blade, a cam member including a cam face, the cam face having a specified cam shape in a direction that is orthogonal to a central axis of the shaft member, the cam member being joined to another end of the shaft member such that the cam member rotates in conjunction with pivoting of the movable blade, and a moving member configured to move in conjunction with a rotation of the cam member, while maintaining contact with the cam face, and the picker is configured such that, by being rotatably supported around the support shaft and by being coupled to the moving member, the picker is able to pivot between the operating position and the non-operating position in conjunction with a movement of the moving member.

5. The sewing machine according to claim 4, wherein the transmission mechanism is configured to move the movable blade from the first position to the third position in a state in which the first cutting edge part and the second cutting edge part are not in contact with one another.

6. The sewing machine according to claim 4, wherein the movable blade is provided with a hook portion hooking the upper thread and the lower thread when the movable blade moves from the second position to the first position, and the transmission mechanism is configured to:

pivot the movable blade around the shaft member such that the first cutting edge part and the second cutting edge part intersect with one another when the movable blade moves from the second position to the third position, to cause the movable blade to cut the upper thread and the lower thread, which have been hooked by the hook portion, maintain the picker in the operating position while the movable blade moves between the third position and the second position, and move the picker to the non-operating position while the movable blade moves between the third position and the first position.

* * * * *